US005190110A

United States Patent [19]

von Blücher et al.

[11] Patent Number: 5,190,110

[45] Date of Patent: Mar. 2, 1993

[54] USE OF AN AQUEOUS SWOLLEN MACROMOLECULE-CONTAINING SYSTEM AS WATER FOR FIRE FIGHTING

[76] Inventors: Hubert von Blücher, Freytagstrasse 45, D-4000 Duesseldorf; Hasso von Blücher, Columbusstrasse 58, D-4000 Duesseldorf 1; Ernest de Ruiter, Hoehenstrasse 57a, D-5090 Leverkusen 3, all of Fed. Rep. of Germany

[21] Appl. No.: 794,786

[22] Filed: Nov. 18, 1991

Related U.S. Application Data

[63] Continuation of Ser. No. 708,082, May 24, 1991, abandoned, which is a continuation of Ser. No. 541,162, Jun. 20, 1990, abandoned, which is a continuation of Ser. No. 855,196, Apr. 23, 1986, abandoned.

[30] Foreign Application Priority Data

May 3, 1985 [DE] Fed. Rep. of Germany ..... 3515865

[51] Int. Cl.[5] ..... A62C 2/00; A62D 1/00; B27N 9/00

[52] U.S. Cl. ..... 169/46; 169/47; 169/5; 169/9; 252/2; 252/8.05; 252/601; 252/603; 252/610; 428/920; 428/921

[58] Field of Search ..... 252/601, 609, 610, 611, 252/2, 6.5, 8.05; 169/46, 47, 45, 9; 8/115.6, 490; 106/18.11; 524/584; 428/920, 921

[56] References Cited

U.S. PATENT DOCUMENTS

| | | | |
|---|---|---|---|
| 3,080,316 | 3/1963 | Petertyl et al. | 252/610 |
| 4,016,894 | 4/1977 | Baldwin et al. | 137/13 |
| 4,017,653 | 4/1977 | Gross | 427/385 A |
| 4,018,951 | 4/1977 | Gross | 427/401 |
| 4,145,296 | 3/1979 | Fox et al. | 252/610 |
| 4,179,367 | 12/1979 | Barthell et al. | 524/556 |
| 4,338,239 | 7/1982 | Dammann | 524/558 |
| 4,351,754 | 9/1982 | Dupré | 524/558 |
| 4,384,988 | 5/1983 | Schoenholz et al. | 252/611 |
| 4,442,018 | 4/1984 | Rand | 252/307 |
| 4,446,202 | 5/1984 | Mischutin | 252/608 |
| 4,510,081 | 4/1985 | Bronner et al. | 252/603 |
| 4,563,287 | 1/1986 | Hisamoto et al. | 252/2 |
| 4,600,606 | 7/1986 | Mischutin | 252/608 |
| 4,610,311 | 9/1986 | Bronner et al. | 169/45 |
| 4,624,320 | 11/1986 | Romanine | 252/608 |

FOREIGN PATENT DOCUMENTS

| | | | |
|---|---|---|---|
| 3114630 | 4/1982 | Fed. Rep. of Germany . | |
| 2706135 | 10/1982 | Fed. Rep. of Germany . | |
| 0012268 | 5/1979 | Japan | 252/610 |
| 0133392 | 10/1981 | Japan | 252/610 |

*Primary Examiner*—Richard D. Lovering
*Assistant Examiner*—Joseph D. Anthony
*Attorney, Agent, or Firm*—Sprung Horn Kramer & Woods

[57] ABSTRACT

In the fighting of fires or protection of objects from fire by applying thereto water, the improvement which comprises dispersing in the water particles of a cross-linked water-insoluble but hightly water-swellable acrylic acid derivative polymer in an amount insufficient to bring the viscosity above 100 mPa's. Advantageously, the particles are present in an amount such that after swelling the swollen particles hold 60 to 70% by weight of the total water, the particles are from 0.1 to 3 mm in diameter and are present in from 0.1 to 0.6% by weight of the water, the polymer being a copolymer of an acrylic acid, the water containing silicic acid and/or a silicate as well as sodium, potassium or ammonium ions. The water is freely pumpable but the swollen particles adhere to surfaces they contact rather than running off rapidly.

12 Claims, No Drawings

USE OF AN AQUEOUS SWOLLEN MACROMOLECULE-CONTAINING SYSTEM AS WATER FOR FIRE FIGHTING

This application is a continuation of application Ser. No. 708,082, filed May 24, 1991, now abandoned, which is a continuation of Ser. No. 541,162, filed Jun. 20, 1990, now abandoned, which is a continuation of Ser. No. 855,196, filed Apr. 23, 1986, now abandoned.

For fire fighting, water is predominantly used in the form available from the network of pipes or—for example, in the case of forest-fire—from natural waters. The mode of operation of the water for fire fighting consists, on the one hand, in that when it comes into contact with articles that are on fire, it brings about, due to its very high heat capacity and heat of vaporization, very effective cooling so that the articles fall below their combustion or ignition temperature, whereby a new ignition is precluded. On the other hand, its effect consists in that when it comes into contact with hot articles, it vaporizes and the produced water vapor expels the air necessary for combustion and causes thereby the flames to be directly extinguished.

The main disadvantage of using water in its conventional form is that a large portion of the water runs off, frequently unused, in objects that are not on fire or sinks into the ground. This is particularly disadvantageous in the case of forest-fires when a considerable portion of the water which is frequently transported at a great expenditure remains totally unused. Especially fire fighting at ground level, is a very important aspect of forest-fire fighting because according to a typical form of forest-fire, the fire further consumes the dry underwood (grass, foliage, heather) and leads to individual crown fires which then unite. To date, it has not been possible to make optimum use of the procured water, in particular because forest-fires are frequently preceded by a long period of dryness and, accordingly, the ground has a particularly high water absorptive capacity.

Basically the same problem is also encountered in other kinds of fires, for example, when a roof truss in a building is on fire in which the roof is not separated by a fire-proof floor from the lower stories. In this case, it is usual that the water reaches the lower stories of the building through floors, openings, staircases, etc., and is thereby lost for fire fighting. While this takes place, there is the danger that for lack of water, the fire spreads out from the burning story downwards. On the other hand, the running off water frequently results in considerable damage and, consequently, an increase of the employed amount of water for fire fighting is problematic.

In order to avoid the disadvantages mentioned above, DE-OS 31 14 630 describes the use of gels as water barrier on the surfaces of those parts of a building, e.g. flat roofs, which run the risk of catching fire, as well as for protecting entire regions from area conflagration. This measure is designed to avoid an undesired loss of water for fire fighting as a result of running off and sinking into the ground. However, these are real gels exhibiting a very high viscosity which cover the article being protected,forming a thick layer thereon. Since gels of the kind do not penetrate into the objects in danger of catching fire, they have a poor extinguishing effect. Their high viscosity also necessitates the use of special equipment for their application.

That fire protective measures with aqueous gels, such as those proposed in DE-OS 31 14 630, have not found wide-spread application is, on the one hand, due to the modest effect of the proposed methods and, on the other hand, due to the necessity of using special apparatuses for the fire fighting measures and, moreover, because they entail corrosion damage and environmental load. water-insoluble, strongly water-swellable polymers, are described, for example, in U.S. Pat. Nos. 4,017,653 and 4,018,951. These substances are designated highly absorptive polymers or super absorbers. This applies in particular to the copolymers of acrylic or methacrylic acid with acrylamide, methacrylamide and acrylonitrile, such as described in DE-PS 2,706,135.

It is an object of the present invention to provide means for fire fighting which reduce damage caused by water, reduce the environmental load, allow use of conventional equipment and avoid corrosion damage.

This object is realized by the invention by using an aqueous system containing potassium, sodium or ammonium salts of dry slightly cross-linked copolymers of the highly absorptive type described, i.e. based on sodium acrylate and/or acrylic acid, the copolymers having a particle size of from 0.02 to 0.5 mm, and being incorporated into the water by stirring or pumping over. Suitable cross-linking agents are all olefinic, at least bifunctional monomers, such as, for, example, methylene-bisacrylamide, divinyl benzene, tris-allylcyanurate, tris-allyl-phosphate, etc. The preparation of the suitable cross-linked polymers by radical or redox-polymerization is known in the art.

In order to accelerate the swelling procedure, finely divided active silicic acid and/or silicates are added, if need be, to the non-swollen copolymers. The active silicic acids that may be added are products which are already known, in particular as fillers or absorbers, such as the silicic acid xerogels having surfaces of more than 30 $m^2/g$, measured according to the BET Method, usually several hundred $m^2/g$, or the active silicic acids having surfaces of from 50 to 450 $m^2/g$ (Aerosil), measured according to the BET Method, prepared by flame hydrolytic decomposition of silicon tetrachloride. Instead of the active silicic acids, also active silicates precipitated from water glass and the corresponding metal salts and possibly mineral acids, in particular silicates of calcium, magnesium or aluminum, having surfaces measured according to the BET Method of more than 30 $m^2/g$, in the form of their xerogels, are applicable for the purposes of the invention, in combination with the highly absorptive polymers.

The aqueous system contains the gel particles in such concentrations that sufficient free water is present to achieve, in the first place, an excellent extinguishing effect with minimum damages caused by water and, in the second place, to allow its application while ensuring a very good wetting capacity, analogous to that of pure water. In the aqueous system of the present invention, from 50 to 80% by weight, preferably from 60 to 70% by weight, of the overall amount of water is present in the gel particles.

The gel particles are formed from the highly absorptive copolymers having a structure which allows them to absorb from 100- to 200-fold of their own weight of water; however, they are not soluble in water. If an excess of water is added to the swollen gel particles, the excess water remains as pure water phase,acting as vehicle for the gel particles, and substantially retains its viscosity, while the gel particles should be regarded as individual discrete particles.

The swelling bodies of the present invention, based on polyacrylic acid (in the form of the sodium or potassium salt) meet the requirements of the invention and do not cause any environmental load.

When adding a product of the kind up to an amount of about 0.6% by weight to water, one detects only a minor increase of viscosity. The liquid remains completely pumpable and after a change from pure water to water having added thereto the swelling bodies during a fire extinguishing operation, the crew working with the jet pipe could not detect any difference in manipulation. When higher amounts are added, the viscosity increases abruptly and the free water, the presence of which characterizes the aqueous system of the invention, decreases rapidly. One can talk of "water for fire fighting" which can be handled as pure water up to a viscosity of 100 mPa.s.

The addition of wetting agents is possible and can be useful in special cases, for example, for extinguishing cotton bales.

The effect of water for fire fighting, prepared by adding the swelling bodies in an amount of 0.4% to water was excellent—as determined in a large scale test series: It was found that in a standard room fire, the amount of extinguishing water and the extinguishing time were reduced by 30 to 35% and the extinguishing water running off from the source of fire was reduced by 85%. An addition of from 0.5 to 0.6% of swollen bodies, already increases the viscosity considerably, however, the fire extinguishing operation can still be carried out as usual.

The discrete gel particles of the present invention have nothing in common with conventional thickening agents which are proposed for increasing the adherence of the water and which lead to a strong increase in viscosity and the disadvantages associated therewith.

Corrosive phenomena on the used extinguishing apparatuses and on the objects sprayed for fire protection can be avoided by adjusting the pH value to from 6 to 8.

The use of the aqueous system of the present invention as water for fire fighting does not necessitate any special pumps or tubes because of the low viscosity. When fighting forest fires or during fire fighting in flight, one can likewise employ conventional equipment. Finally, the use in Type W fire extinguishers and in sprinkler apparatuses is also possible.

When using the aqueous system for fire fighting of the present invention, the accompanying gel particles do not prevent the water from penetrating into the burning article, however, they do not show any tendency to run off and in view of their own adhesive capacity remain on the objects which are burning or run the risk of burning and, in addition, in case of great heat development, they allow the water contained therein to escape easily in the form of vapor such that the entire water for fire fighting is available for cooling and vapor formation. The amount of necessary extinguishing liquid is substantially reduced thereby, as compared to conventional means. Moreover, a very effective protection against the spreading of the fire results.

In fighting fires in storage tanks, the cooling of the wall is important. By virtue of the aqueous system, it is possible during the extinguishing operation to spray the wall of the tank only from time to time with the same tube, the adhering gel particles making a permanent sprinkling superfluous and allowing a better exploitation of the tube capacity. The risk of repeated flaring up of the fire is reduced due to the gel particles which adhere to the extinguished article.

The addition of the swelling bodies may be effected in the container of a triple combination pumper, in a "water bomber" or in particular mixing containers; it may be necessary to slightly stir or moderately pump over during the spreading or some minutes after the termination of the spreading. The swollen gel particles do not adhere to each other. They may slightly precipitate during prolonged rest periods, however, they can be easily pumped over or stirred without any problem, even after weeks. This is, however, normally not necessary.

The usual method of applying the invention is to sprinkle or spray the aqueous system including the formed gel particles. If desired, a variant consists in adding the swelling bodies shortly in advance of the jet pipe in the non-swollen condition. Although the advantage of the higher adhesive capacity of the gel particles for protecting objects which have still not caught fire is then not made use of, one achieves very quickly an effective protection against damage caused by water because the particles that are swollen after a very short time seal the gaps and joints. Once a sealing layer of the gel is formed, one can continue the operation with pure water, insofar as this appears useful. In the case of forest-fires, part of the gel remains on the trees due to its adhesive property and forms a good protection against the spreading of the fire from one tree crown to the other. In the case of fire in a building consisting of many stories, a water cover is formed which can prevent the fire from spreading all over the rest of the building.

A further use according to the invention consists in the manufacture of fire extinguishing blankets which, for example, may be kept ready in the form of wraps for helping people to escape in plants and big buildings, such as hotels, with high fire hazard. Fire extinguishing blankets of the kind contain the swelling bodies in the swollen condition and, for avoiding a loss of moisture, they are sealed, for example, in a plastic bag or envelop.

It will be understood that the specification and examples are illustrative but not limitative of the present invention and that other embodiments within the spirit and scope of the invention will suggest themselves to those skilled in the art.

What is claimed is:

1. In the fighting of fires for protection of objects from fire by applying thereto water, the improvement which comprises dispersing in the water particles of a cross-linked water-insoluble but highly water-swellable acrylic acid derivative polymer in an amount insufficient to bring the viscosity above 100 mPa's, the particles being present in an amount such that after swelling the swollen particles hold 50 to 80% by weight of the total water.

2. The method according to claim 1, wherein the particles are present in from 0.1 to 0.6% by weight of the water.

3. The method according to claim 1, wherein the swollen gel particles are from 0.1 to 3 mm in diameter.

4. The method according to claim 1, wherein the polymer is a copolymer of an acrylic acid and the water contains sodium, potassium or ammonium ions.

5. The method according to claim 1, wherein the particles are present in an amount such that after swelling the swollen particles hold 60 to 70% by weight of the total walter.

6. The method according to claim 1, wherein the water further contains silicic acid and/or a silicate.

7. The method according to claim 5, wherein the swollen gel particles are from 0.1 to 3 mm in diameter and are present in from 0.1 to 0.6% by weight of the water, the polymer being a copolymer of an acrylic acid, the water containing silicic acid and/or a silicate as well as sodium, potassium or ammonium ions.

8. The method according to claim 7, wherein the water contains sodium silicate.

9. A fire extinguisher filled with water having dispersed therein particles of a cross-linked water-insoluble but highly water-swellable acrylic acid derivative polymer in an amount insufficient to bring the viscosity above 100 mPa's, the particles being present in an amount such that after swelling the swollen particles hold 50 to 80% by weight of the total water.

10. A fire extinguisher according to claim 9, wherein the particles are present in an amount such that after swelling the swollen particles hold 60 to 70% by weight of the total water, the swollen gel particles are from 0.1 to 3 mm in diameter and are present in from 0.1 to 0.6% by weight of the water, the polymer being a copolymer of an acrylic acid, the water containing silicic acid and/or a silicate as well as sodium, potassium or ammonium ions.

11. A fire extinguishing blanket-like article containing water having dispersed therein particles of a cross-linked water-insoluble but highly water-swellable acrylic acid derivative polymer in an amount insufficient to bring the viscosity above 100 mPa's, the particles being present in an amount such that after swelling the swollen particles hold 50 to 80% by weight of the total water.

12. A blanket according to claim 11, wherein the particles are present in an amount such that after swelling the swollen particles hold 60 to 70% by weight of the total water, the swollen gel particles are from 0.1 to 3 mm in diameter and are present in from 0.1 to 0.6% by weight of the water, the polymer being a copolymer of an acrylic acid, the water containing silicic acid and/or a silicate as well as sodium, potassium or ammonium ions.

* * * * *